US005725386A

United States Patent [19]

Davis et al.

[11] Patent Number: 5,725,386

[45] Date of Patent: Mar. 10, 1998

[54] BOARD-MOUNTABLE ELECTRICAL CONNECTOR

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 705,932

[22] Filed: Aug. 30, 1996

Related U.S. Application Data

[63] Continuation-in-part of Ser. No. 653,144, May 24, 1996, abandoned.

[51] Int. Cl.[6] ..... H01R 9/09

[52] U.S. Cl. ..... 439/79; 439/607

[58] Field of Search ..... 439/79, 80, 607

[56] References Cited

U.S. PATENT DOCUMENTS

| | | | |
|---|---|---|---|
| Re. 32,760 | 10/1988 | Chandler et al. | 439/188 |
| 3,949,180 | 4/1976 | Ojima et al. | 200/51.1 |
| 4,070,557 | 1/1978 | Ostapovitch | 200/51.1 |
| 4,210,376 | 7/1980 | Hughes et al. | 339/17 LC |
| 4,224,485 | 9/1980 | Krumreich | 200/51.1 |
| 4,274,691 | 6/1981 | Abernethy | 339/19 |
| 4,405,189 | 9/1983 | Douty et al. . | |
| 4,410,230 | 10/1983 | SanMiguel | 339/176 M |
| 4,425,015 | 1/1984 | Rizzo | 339/17 LC |
| 4,438,303 | 3/1984 | Astier | 200/51.1 |
| 4,550,962 | 11/1985 | Czeschka | 339/17 LC |
| 4,552,423 | 11/1985 | Swengel, Jr. | 339/19 |
| 4,582,376 | 4/1986 | Olsson | 339/19 |
| 4,639,056 | 1/1987 | Lindeman et al. | 339/17 LC |
| 4,671,599 | 6/1987 | Olsson | 439/188 |
| 4,715,820 | 12/1987 | Andrews, Jr. et al. | 439/59 |
| 4,725,241 | 2/1988 | Bertini et al. | 439/188 |
| 4,744,769 | 5/1988 | Grabbe et al. | 439/284 |
| 4,802,860 | 2/1989 | Kikuta | 439/79 |
| 4,815,982 | 3/1989 | Sadigh-Behzadi | 439/82 |
| 4,842,528 | 6/1989 | Frantz | 439/80 |
| 4,863,393 | 9/1989 | Ward et al. | 439/507 |
| 5,030,123 | 7/1991 | Silver | 439/188 |
| 5,037,334 | 8/1991 | Viselli et al. | 439/733 |
| 5,071,372 | 12/1991 | Viselli et al. | 439/733 |
| 5,080,596 | 1/1992 | Viselli et al. | 439/79 |
| 5,085,601 | 2/1992 | Buchter et al. | 439/660 |
| 5,096,428 | 3/1992 | Lwee et al. | 439/79 |
| 5,112,238 | 5/1992 | Cizin | 439/188 |
| 5,122,078 | 6/1992 | Davis et al. | 439/405 |
| 5,123,854 | 6/1992 | Petersen et al. | 439/188 |
| 5,145,383 | 9/1992 | Bowen et al. | 439/78 |
| 5,199,886 | 4/1993 | Patterson | 439/79 |
| 5,266,038 | 11/1993 | Nakamura | 439/79 |
| 5,316,489 | 5/1994 | Kachlic et al. | 439/79 |
| 5,334,025 | 8/1994 | Fohl | 439/188 |

FOREIGN PATENT DOCUMENTS

| | | |
|---|---|---|
| 0 385 577 | 9/1990 | European Pat. Off. . |
| 7-272803 | 3/1994 | Japan . |

OTHER PUBLICATIONS

*AMP Catalog 82066, Rev. 8–95*, "Modular Interconnection System", pp. 1–23; Aug., 1995; AMP Incorporated, Harrisburg, PA.

*AMP Drawing C–95–8083–20*, "Overmold, Plug Assembly, 4 Position, USB", Dec. 1995; AMP Incorporated, Harrisburg, PA.

*AMP Drawing C–787616*, "Receptacle Assembly, Right Angle, 4 Position, Thru–hole, USB", Nov. 1995; AMP Incorporated, Harrisburg, PA.

*Primary Examiner*—Neil Abrams

*Attorney, Agent, or Firm*—Anton P. Ness

[57] ABSTRACT

Electrical connector (10) including housing (12), contacts (14) and shield (16), with contact sections (24) arrayed vertically in plug-receiving cavity (60) offset toward housing side (42). Vertical sections (32) of contacts (14) are centered with respect to the connector by virtue of offset portions (70), and are held precisely positioned and centered by slots (78,90) at rear edges of wall sections (74,88) to be aligned with respective circuit board through-holes.

12 Claims, 4 Drawing Sheets

BOARD-MOUNTABLE ELECTRICAL CONNECTOR

RELATED APPLICATION INFORMATION

This is a continuation-in-part application of U.S. patent application Ser. No. 08/653,144 filed May 24, 1996 and now abandoned.

FIELD OF THE INVENTION

The present invention relates to the field of electrical connectors and more particularly to connectors mountable to circuit boards.

BACKGROUND OF THE INVENTION

In Ser. No. 08/653,144 filed May 24, 1996, an electrical connector is disclosed to be mountable to a circuit board and having an array of contacts with contact sections disposed in a row parallel to the circuit board along the mating face, with solder tails at right angles to the contact sections and similarly disposed in a row for insertion into respective through-holes of the circuit board. The contact sections are spring arms disposed along a support wall of the insulative housing, in respective channels with contact surfaces defined on arcuate portions protruding above the channels for engagement with complementary contacts of a mating connector. The support wall and contact sections are disposed within and offset to one side of a plug-receiving cavity defined by a shield member having a generally rectangular shape with its longer dimension parallel to the circuit board.

It is desired to orient the mating face of the connector perpendicular to the circuit board, with the row of contacts oriented perpendicular to the circuit board, and the right angle sections in a common row staggered rearwardly of the housing such that the topmost contact extends farthest rearwardly. It is also desired to center the location of the solder tails with respect to the connector, while maintaining the contact sections horizontally offset along the mating face.

It is further desired to assure the accurate positioning of the centered vertical sections of the contacts for alignment with respective through holes of the circuit board.

SUMMARY OF THE INVENTION

In the present invention, the vertical contact sections are held precisely in a centered position by being held within slots of the housing at two vertically spaced locations, in alignment with the intended circuit board through-hole location.

The horizontal body sections and contact sections of the contacts are positioned nearer to one side of the housing, with the rearward ends of the body sections concluding in offset sections extending horizontally to a generally centered position of the housing prior to extending vertically toward the board-mounting face of the connector to ultimately conclude in solder tails. Passageways in which the contact body sections are respectively disposed are vertically spaced along the housing side, with the bottom wall of the topmost passageway extending farthest rearwardly and the bottom of the succeeding passageways extending less far rearwardly.

The bottom housing wall and each passageway bottom wall extend to a rear edge farther than the respective contact's rearwardmost portion, and a slot is defined forwardly from the rear edge through which the vertical section of the contact extends, such that the slot precisely positions the top portion of the vertical contact section in alignment with the intended location of a circuit board through-hole. The bottom housing wall includes a slot extending forwardly such that the vertical sections of all contacts extend downwardly therethrough, assuredly holding bottom portions of the vertical contact sections precisely in position and aligned with the top portions of the vertical contact sections.

An embodiment of the present invention will now be described by way of example with reference to the accompanying drawings.

DETAILED DESCRIPTION

Figure 1:
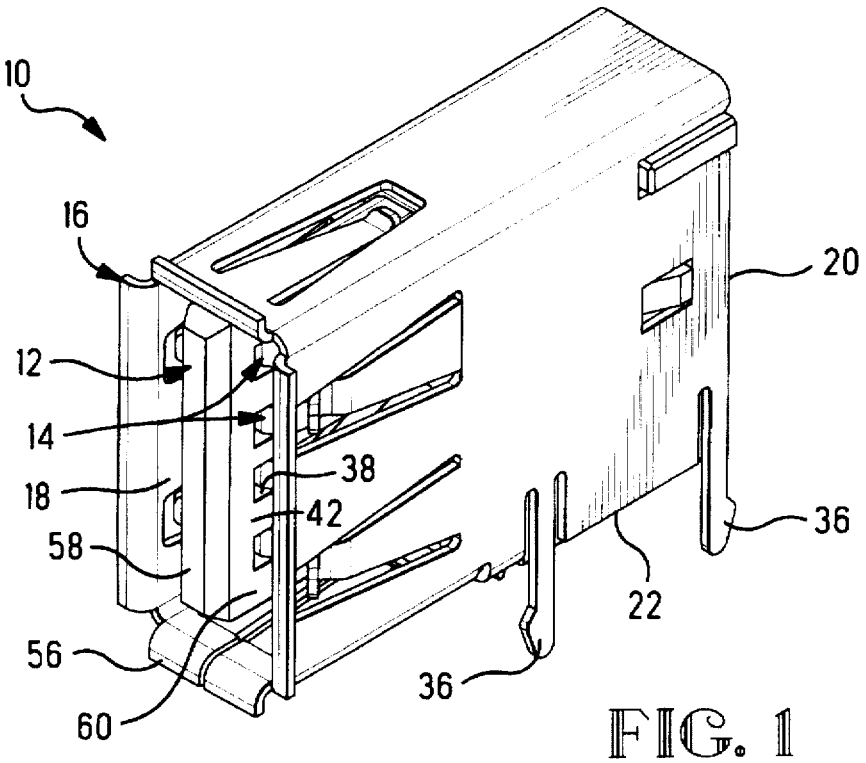
FIGS. 1 and 2 are isometric views of the connector of the present invention from forwardly thereof, assembled and exploded, respectively.

In FIGS. 1 to 4, connector 10 is seen to include an insulative housing 12, a plurality of contacts 14 and a shield 16, and extends from a mating face 18 to a rear face 20, with a board-mounting face 22 along the connector bottom for mounting to a circuit board (not shown). Contacts 14 each include a contact section 24 disposed along mating face 18, a body section 26 extending along a respective passageway 28 of housing 12, a vertical right angle bend 30 and a vertical section 32 concluding in a solder tail 34 depending below board-mounting face 22 for insertion into a respective through-hole of the circuit board. Shield 16 includes a plurality of ground sections 36 also adapted for insertion into respective through-holes of the circuit board to establish ground connections with ground circuits of the board.

Contact sections 24 extend forwardly from passageways 28 and along channels 38 defined along a side surface 40 of a support wall 42 extending forwardly from housing body 44, with free ends 46 trapped beneath lips 48 at forward ends of channels 38 while arcuate portions 50 protrude from channels 38 and beyond side surface 40. Body sections 26 of contacts 14 include retention sections 52 having barbs 54 adapted to bite into adjacent surfaces of passageways 28 to retain contacts 14 in position within housing 12 upon full insertion from rear face 20.

Shield 16 extends to a forward end 56 forwardly of the front edge 58 of support wall 42 and defining a plug-receiving cavity 60 therearound. It is seen that support wall 42 and contact sections 24 are offset from the center of plug-receiving cavity 60 toward side 62 of housing 12, with arcuate portions 50 of contact sections 24 extending above channels 38 and generally to the center of cavity 60, aligned vertically. Body sections 26 are similarly offset toward housing side 62 within passageways 28.

Figure 5:
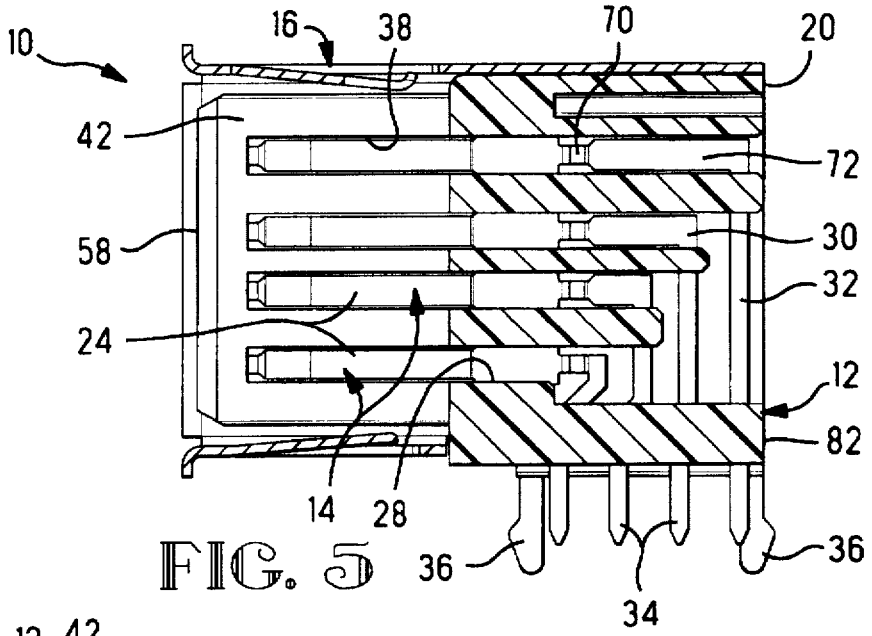
FIGS. 5 and 6 are longitudinal side and top section views of the connector of FIGS. 1 to 4 taken along lines 5—5 and 6—6 of FIG. 7 respectively.
Figure 6:
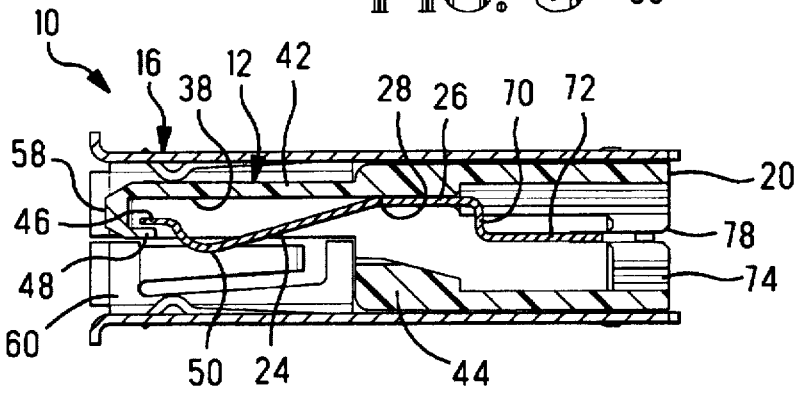
Figure 7:
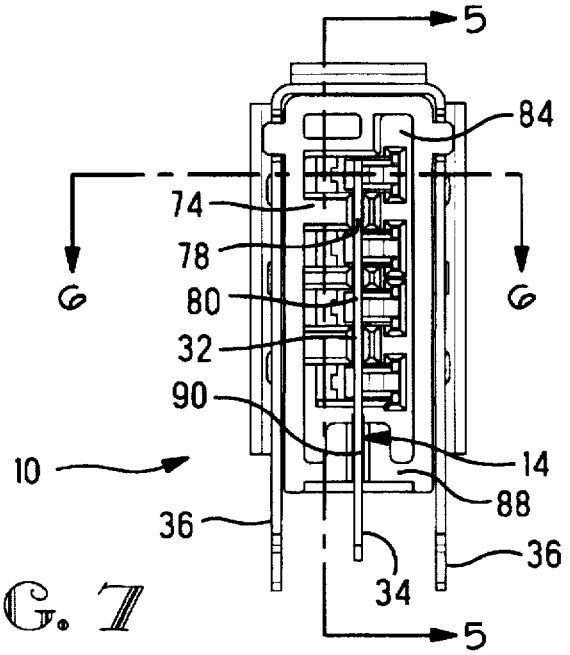
FIG. 7 is a rear elevation view of the connector of FIGS. 1 to 4.

Referring now to FIGS. 5 to 7, each contact body section 26 includes an offset portion 70 that locates the rear horizontal portion 72 of the contact 14 at the horizontal center of the housing. The passageway 28 associated with each contact 14 is relatively large to facilitate insertion of the contact section 24 from rear housing face 20, of each contact 14 with its arcuate shape extending horizontally from an offset body section 26, and thus the side walls of the passageway 28 are not adapted to position and hold the rear portions of the contacts precisely and centered horizontally while maintaining the vertical position of the contacts.

The housing 12 provides a wall section 74 beneath each rear horizontal contact portion 72 extending farther rearwardly to a rear edge 76. A slot 78 is defined vertically through wall section 74 beneath vertical right angle bend 30, and the top portion 80 of each vertical contact section 32 extends therethrough, with the slot holding the top portion in a precisely positioned centered location. Each wall section 74 preferably is adjacent the top edge of the immediately adjacent lower contact, and serves to maintain the vertical position thereof.

Figure 3:
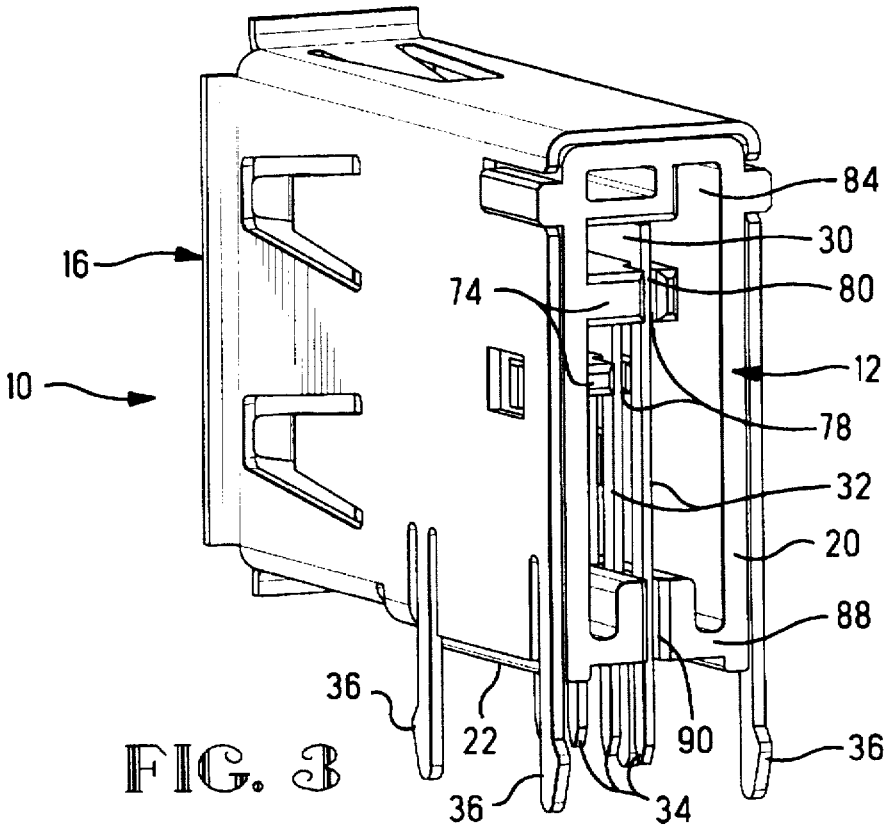
FIGS. 3 and 4 are similar to FIGS. 1 and 2 from rearwardly thereof.
Figure 2:
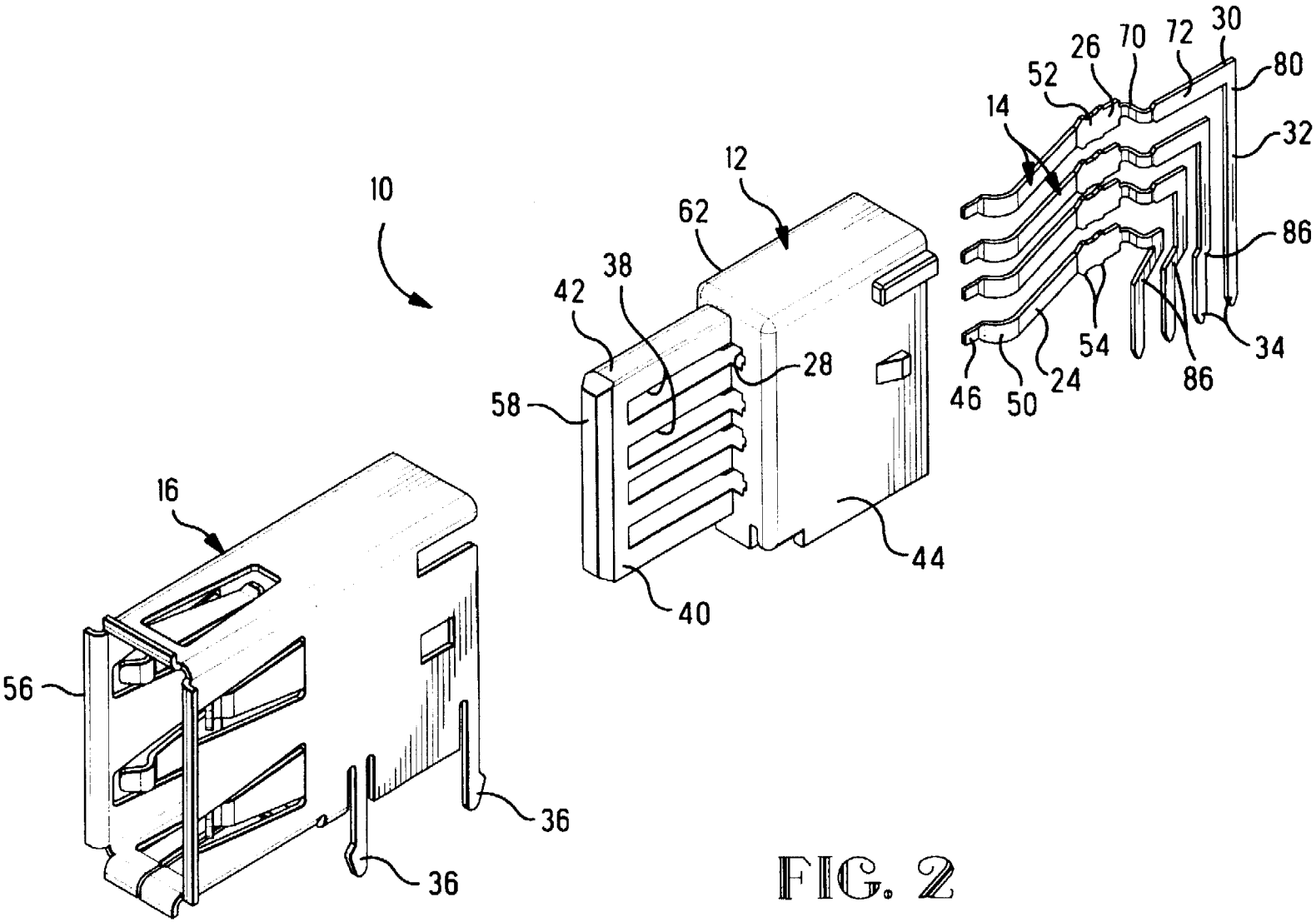
Figure 4:
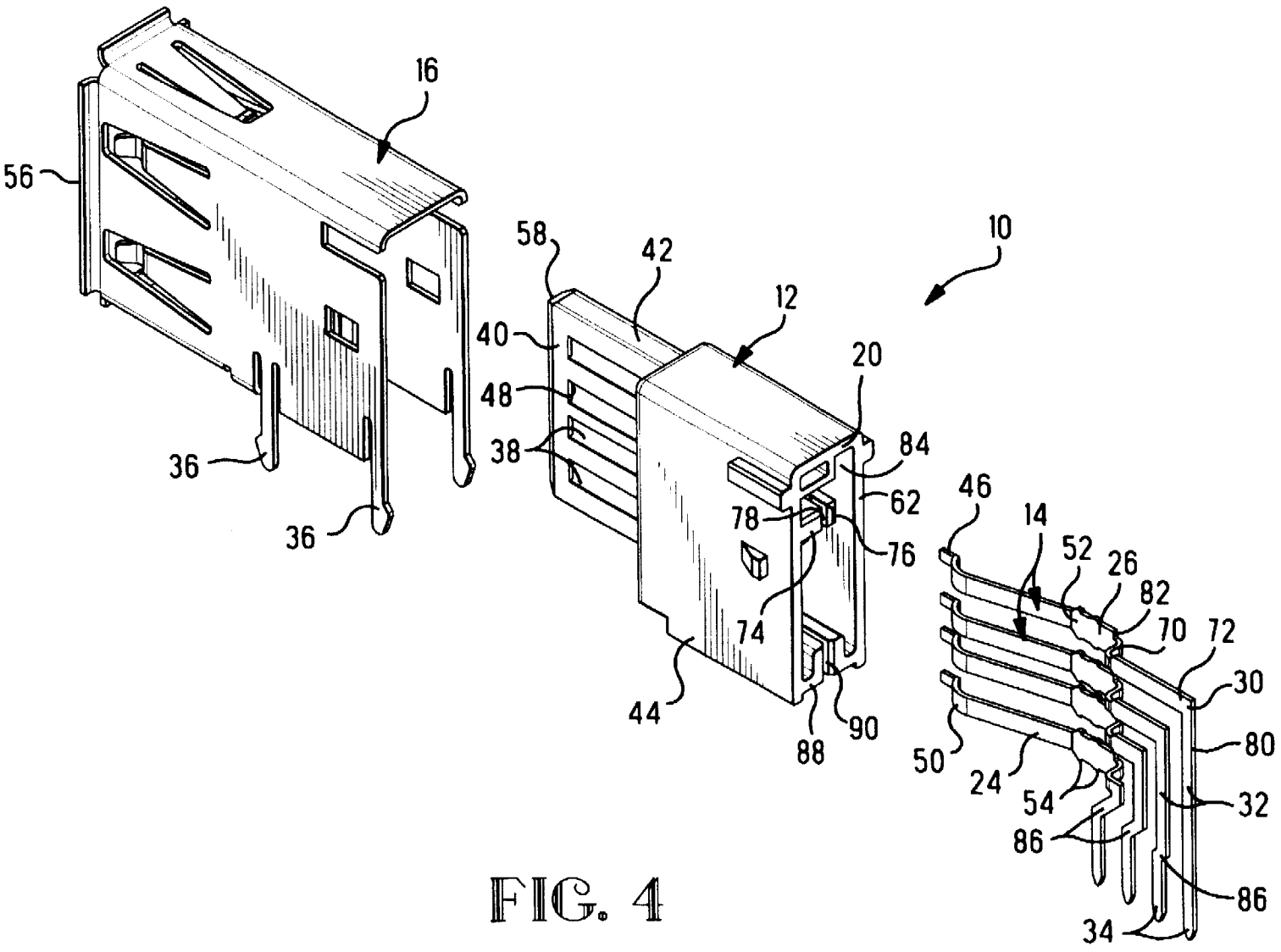

Each body section also preferably includes rearwardly facing surfaces 82 adjacent to retention sections 52 for engagement by push tooling used during contact insertion. Housing 12 preferably defines a vertical clearance 84 along side 62 for receipt of insertion tooling thereinto during final stages of contact insertion, as best seen in FIGS. 3 and 4. The use of offset portions 70 moves the vertical sections 32 to the side to permit access of the insertion tooling (not shown) to push surfaces 82 near the retention sections 52 for optimizing successful insertion. Additionally, it is preferable to center the solder tails to assure maximized spacing thereof from ground sections 36 of shield 16 to best prevent any bridging of solder therebetween. Similarly, it is preferred to space the solder tails 34 from each other (such as 2.0 mm) by using angled transition sections 86 near the bottoms of vertical sections 32 of most of the contacts 14, but maintaining the vertical sections spaced closely to each other to minimize the overall length of the connector.

Bottom housing wall 88 extends to rear face 20 and includes a vertical slot 90 therethrough extending forwardly from rear face 20 to a position forwardly of vertical right angle bend 30 of the bottommost contact 14 and also forwardly of the solder tail thereof resulting from transition section 86. Top portion 80 of bottommost contact 14 extends therethrough, as do the vertical contact sections 32 of all other contacts 14. The elongate vertical sections 32 of the contacts above the bottommost are thus held precisely positioned centered with respect to housing 12 in two spaced locations thus maintaining the precise vertical alignment thereof.

Variations and modifications may occur to the specific embodiment disclosed herein, that are within the spirit of the invention and the scope of the claims.

What is claimed is:

1. An electrical connector comprising:

an insulative housing extending from a mating face to a rear face and further including a board-mounting face orthogonal to said mating face, and a plurality of contacts disposed in respective passageways of said housing following insertion of said contacts into said rear face, each said contact including contact sections exposed along said mating face, a body section extending therefrom toward said rear face to a right angle section, and a vertical section depending from said right angle section to a solder tail depending below said board-mounting face for electrical connection with corresponding conductive sections of a circuit board;

said contact sections being arrayed in a vertical row along said mating face horizontally offset toward one side of said housing, with body sections of said contacts being proximate said one side in respective said passageways, and said right angle sections and vertical sections being arrayed in a vertical row along said rear face substantially centered horizontally with respect to said housing;

each said contact body section including an offset portion spaced inwardly from said mating face and forwardly of said right angle section of said contact and extending horizontally from said one side of said housing substantially to a center thereof;

said housing including wall sections beneath and adjacent to said right angle sections of respective said contacts and extending rearwardly beyond said vertical sections thereof, and each said wall section including a vertical slot extending forwardly from a rear edge thereof to a location forwardly of said vertical section of said contact, such that said vertical section of said contact extends therethrough upon full insertion into said housing, whereby said slots of said wall sections hold top portions of said vertical contact sections in a selected position for aligning said solder tails with respective said conductive portions of said circuit board.

2. The connector as set forth in claim 1 wherein said housing includes a bottom wall extending to said rear face and including a vertical slot defined thereinto extending from a rear edge thereof to a location forwardly of the forwardmost of said vertical sections, wherethrough extend bottom portions of said vertical sections above said solder tails for positioning bottom portions of said vertical sections for assisting in aligning said solder tails with respective said conductive portions of said circuit board and in cooperation with said slots of said wall sections in maintaining vertical alignment of said vertical sections.

3. The connector as set forth in claim 1 wherein a shield member surrounds said housing and includes ground sections depending below said board-mounting face horizontally substantially spaced from said solder tails.

4. The connector as set forth in claim 1 wherein at least some of said contacts include transition sections extending respective selected distances forwardly from bottom portions of said vertical sections above said solder tails, whereby said vertical sections may be spaced apart selected small distances while said solder tails may be spaced apart distances greater than said selected small distances, such that the length of said connector is minimized.

5. The connector as set forth in claim 4 wherein all said solder tails, all said transition sections, all said vertical sections, and all said right angle sections are disposed in a common vertical plane.

6. The connector as set forth in claim 1 wherein said offset portions of all said contacts are substantially vertically aligned, and at least some of said contacts include horizontal sections extending rearwardly from said offset portions to said right angle sections.

7. The connector as set forth in claim 6 wherein all said solder tails, all said vertical sections, all said right angle sections and all said horizontal sections are disposed in a common vertical plane.

8. The connector as set forth in claim 1 wherein each said contact body section includes a retention section having retention barbs defined thereon for biting engagement with side walls of said passageways to retain said contact in said passageway, and said offset portion is located rearwardly of said retention section.

9. The connector as set forth in claim 8 wherein said retention sections of said contacts include rearwardly facing push surfaces at rearward ends thereof engageable by insertion tooling for pushing said contacts into said passageways during connector assembly.

10. The connector as set forth in claim 8 wherein said offset portions are just rearwardly of said push surfaces facilitating said contact insertion.

11. The connector as set forth in claim 8 wherein said push surfaces of all said contacts are vertically aligned adjacent said one side of said housing, and said housing includes a vertical clearance adjacent said one side of said housing for receipt of said insertion tooling thereinto during connector assembly.

12. The connector as set forth in claim 11 wherein said offset portions of all said contacts are substantially vertically aligned just rearwardly of said push surfaces and have reduced height to permit engagement of insertion tooling with said push surfaces.

* * * * *